US006336875B1

(12) United States Patent
Rice

(10) Patent No.: US 6,336,875 B1
(45) Date of Patent: Jan. 8, 2002

(54) FANTASY GOLF GAME

(76) Inventor: Ronald J. Rice, 9789 Casey's Crossing, West Chester, OH (US) 45069

( * ) Notice: Subject to any disclaimer, the term of this patent is extended or adjusted under 35 U.S.C. 154(b) by 0 days.

(21) Appl. No.: 09/562,016

(22) Filed: May 2, 2000

Related U.S. Application Data

(63) Continuation of application No. 09/103,149, filed on Jun. 22, 1998, now abandoned.

(51) Int. Cl.[7] ..... A63B 69/36
(52) U.S. Cl. ..... 473/407; 473/168; 473/150
(58) Field of Search ..... 473/150, 168, 473/407

(56) References Cited

U.S. PATENT DOCUMENTS

| | | | | |
|---|---|---|---|---|
| 1,470,117 A | * | 10/1923 | MacRae | 473/150 |
| 3,937,466 A | * | 2/1976 | Candor | 473/407 |
| 4,783,071 A | * | 11/1988 | Tattershall | 473/407 |
| 5,564,988 A | * | 10/1996 | Brooks | 473/168 |

* cited by examiner

*Primary Examiner*—Mark S. Graham
(74) *Attorney, Agent, or Firm*—Jack C. McGowan

(57) ABSTRACT

A simulated golf game whereby a scale course map, rules of play and a ball locator device for plotting the location of each shot are used by a player in conjunction with actual shots taken at a conventional golf driving range. For each driving range shot, the player estimates its distance, and then uses a ball locator device to measure the angle of deviation and to plot the position of the ball on the course map.

3 Claims, 6 Drawing Sheets

FANTASY GOLF GAME

This appln is a cont of Ser. No. 09/103,149 filed Jun. 22, 1998, Abn.

BACKGROUND OF THE INVENTION

1. Field of the Invention

The present invention relates to the game of golf, and more particularly to a simulated golf game where play takes place at a practice field, such as a driving range and in which the players simulate playing various holes on an actual course by using a scale course or hole map, a protractor-like ball locating device, and traditional golfing implements, including clubs, tees and balls.

2. Description of the Related Art

The game of golf has been played since the 15th century in Scotland. The game is played by individual competitors, whose object is to drive a small, hard ball with one of a set of clubs toward and into a series of holes. The player who puts the ball into the holes with the fewest strokes is the winner. The series of holes constitutes a course, and typically, the game is played outdoors on a course having 9, 18 or 36 holes, although any number can be involved.

In recent years, variations on the traditional game of golf have been devised. These include a 9 or 18 hole course that covers substantially less terrain than the traditional game of golf (known as "miniature golf"), hand held and board games where the strokes of the players are determined by chance devices, such as dice or spinners, and computerized games.

More recently, driving ranges have been proposed at which a series of fairways and greens are positioned end to end to provide a succession of targets, such as shown in U.S. Pat. No. 5,092,600. Also, a special course with a number of tees and greens compactly arranged within a relatively small (12 acres) tract can be found.

Simulated golf games such as U.S. Pat. No. 4,280,056 utilize practice driving ranges but require the use of a computer and are less than realistic because they do not account for the impact of a slice or a hook when playing. U.S. Pat. No. 1,470,117 is an example of a simulated indoor golf game; however, it requires the use of a special machine. The machine is quite complex and does not accurately measure the degree of "hook" or "slice". Hence, it is not as realistic as would be desirable.

Against this background of known technology, the inventor has developed a novel simulated golf game enabling the player to use conventional golf equipment at a driving range, hole or course layout, and a device to help determine the location of the ball after each player's stroke, hereinafter also referred to as a ball locator means.

SUMMARY OF THE INVENTION

The present invention pertains to a novel simulated golf game which utilizes a protractor-like device hereafter referred to as a ball locator means comprised of two legs movably attached to each other at one end. At least one of said legs incorporates a scale matching the scale of a course map, said course map comprising features which can be similar to those found on a well-known actual course. A player simulates playing an actual game of golf at a practice field, such as a driving range, using conventional golf equipment, a hole or course layout and the ball locator means to plot the location of each shot on the course map.

OBJECTS OF THE INVENTION

It is therefore an object of the present invention to provide a novel indoor or outdoor golf game in which the players can simulate playing golf using conventional golf equipment at a driving range or even using a smaller area such as one's own property, using scaled-down yardage marker.

It is a primary object of the present invention to provide a simulated golf game which can be played at a conventional golf driving range with conventional golf equipment.

It is a further object of the present invention to enable a golf enthusiast to simulate play at a variety of famous golf courses.

It is also an object of the present invention to account for "slices" and "hooks" in a simulated golf game that will also better prepare the player for an actual round of golf by utilizing a wider variety of golf clubs and by encouraging improvement in accuracy with respect to both distance and direction.

Another object of the present invention is to provide a novel golf game that is less expensive than actual golf and which can be enjoyed at the player's pace without pressure from others waiting to play.

It is another object of the present invention to provide a game that can be completed in less time than a regular round of golf, thus enabling enjoyment of the strategy of golf in spite of limited time to play.

Further objects and advantages as well as features and details of the present invention will be apparent from the accompanying drawings, specification and claims.

DETAILED DESCRIPTION OF THE INVENTION

Figure 1:
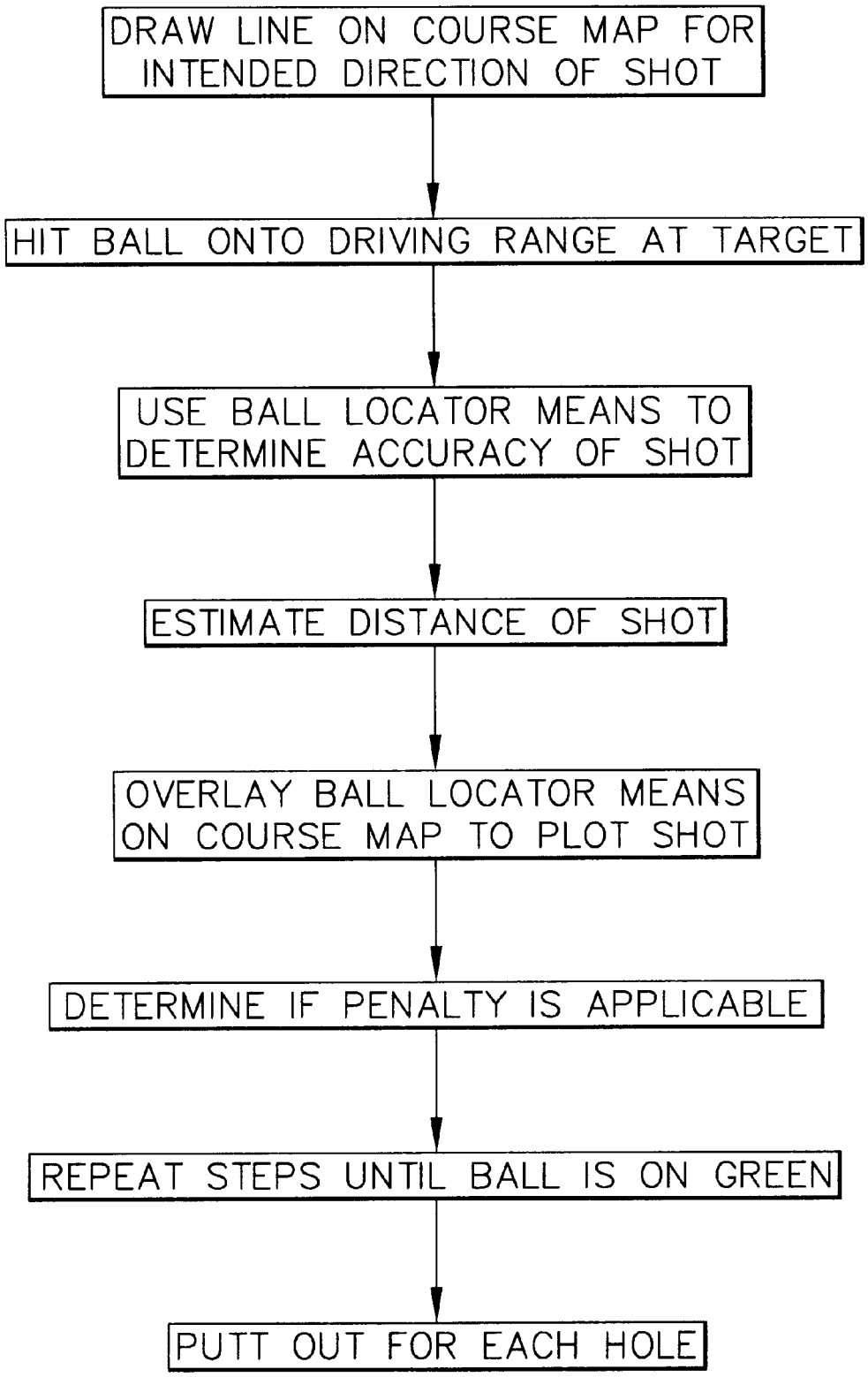
FIG. 1 is a block diagram showing the sequence of steps a player would follow in the play of the game according to the present invention.

FIG. 1 is a block diagram showing the sequence of steps a player would follow in the play of the simulated golf game according to the present invention. In carrying out the invention a course map illustrating each of the holes of the golf course, typically 18, will be used. The course map will be laid out showing various topographical features and will be drawn to a certain scale. The object of the simulated game is the same as in actual golf, which is to hit the golf ball onto the green and into the hole in as few golf strokes as possible.

Figure 2:
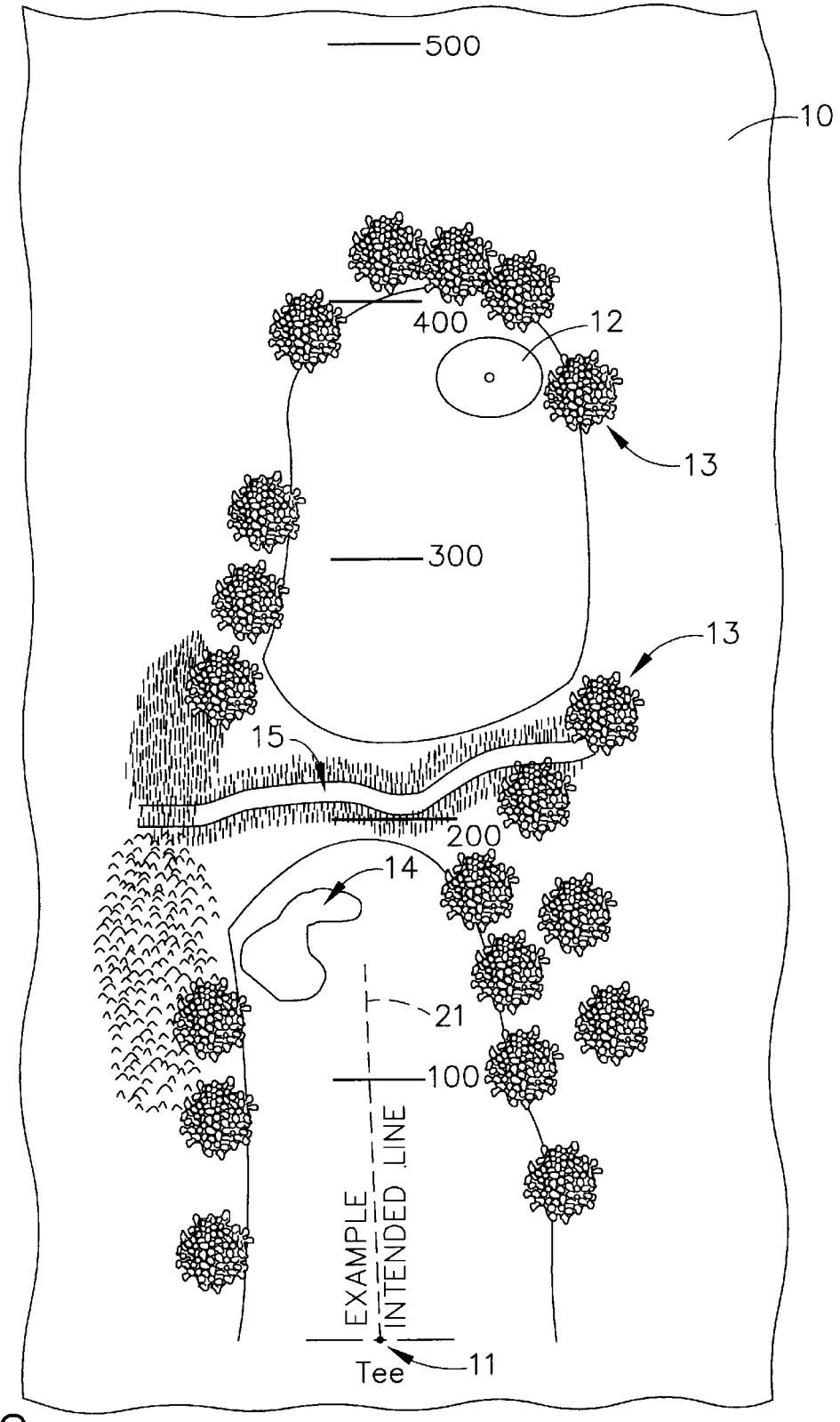
FIG. 2 shows a hole layout on a card according to the present invention.

FIG. 2 shows a sample hole layout 12 on a card according to the present invention. On this layout one may see the tee, 11 the green 12, and various features of the hole, including trees 13, a sand trap 14 and water hazard 15. It will be clear to those skilled in the art that there will be a different illustration for each hole to be played.

Figure 3:
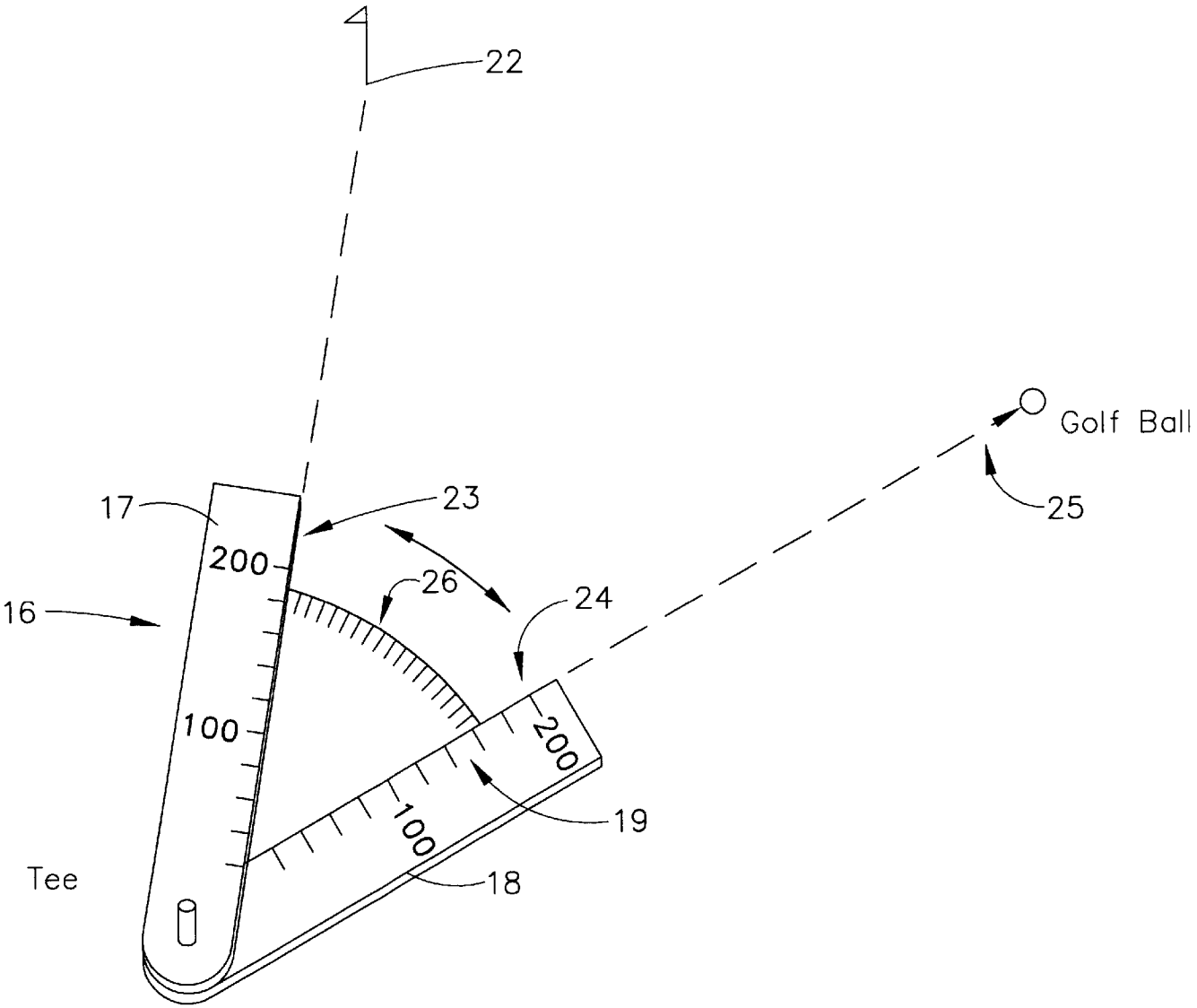
FIG. 3 shows the ball locator means according to the present invention.

In placing the ball at the completion of each stroke, the player uses a ball locator means 16, one embodiment of which is shown in FIG. 3. The ball locator means is comprised of two legs 17 and 18 which are pivotally attached to each other. At least one of the legs has a scale 19 corresponding to the scale to which the map has been drawn. The ball locator means also has a second means 20 by which to measure the angle between the legs, such as a protractor.

In making a shot, a player draws a straight line 21 in FIG. 2 on the course map starting at the tee along the intended direction to hit the ball. The player then tees the ball at a conventional golf driving range and selects a distant target such as a yardage marker 22 as shown in FIG. 3 which is typically found at the driving range. After the player tees off, the distance of the shot is determined using the driving range yard markers. The player may determine the degree of "slice" or "hook", if the ball has not been driven along the intended direction by using the ball locator means 16, as shown in FIG. 3. This is done by lining up the inside edge 23 of one side of the ball locator means with the intended distant target. One then lines up the inside edge 24 of the other leg with the actual location of the golf ball 25, which provides the angle 26 between the intended direction 21 and the actual direction which the ball was hit.

The player then overlays the ball locator means on the course map aligning one inside edge along the line for the intended direction, and the other edge will either be to the left for a "hook" or to the right for a "slice" if the ball has not been precisely hit. One then places a mark or point on the course map along the inside edge of the leg of the ball locator means which represents the actual flight of the ball at a distance that corresponds to the length of the driving range stroke. These steps are repeated until the golf ball is on the green.

There are various yardage penalties which may be assessed should the ball have encountered trees, water hazards or sand traps on the simulated course map. Possible examples follow, but it will be understood by those skilled in the art that many variations are possible. In order to hit over trees from the fairway, one must use a pitching wedge at the golf driving range. The ball must lie more than 30 yards away from the leading edge of the trees and must fall more than 20 yards past the farthest edge of the trees. If the ball does not fall more than 20 yards past the farthest edge of the trees, it is placed just beyond the farthest edge of the trees.

A ball which is hit through trees must be struck by a golf club known as an iron, and the ball yardage is decreased by 50% to account for lost momentum due to striking a tree. Obviously, other percentages may be used depending upon the number of trees that are struck during the flight of the ball.

When a ball lands in a sand trap, the player must use a pitching wedge at the driving range and one-half of the actual distance is used to plot the location of the ball on the course map. For shots which have landed in the rough, an iron must be used and the yardage is reduced by 20 yards. When a ball has landed in heavy vegetation or in streams or other water hazards, a new ball must be dropped. It is also contemplated that "out-of-bounds" would be whenever the ball lands more than 40 yards off the fairway.

After the ball is hit onto the green, the remaining shots for that hole may be completed on the practice putting green commonly available at most driving ranges. The ball is placed on the putting green at a distance from the hole equal to that estimated on the course map using the distance scale on the ball locator means. The player may then putt the ball into the hole and add the total number of putt strokes onto the number of strokes already taken for that hole. It is at the player's discretion when to complete the putts for each hole. One possibility is to complete the putts for each hole immediately after reaching the green. In the alternative the player may complete all the putts at one time after reaching the greens for all holes.

It will occur to those skilled in the art that this invention may be used in other applications than strictly with a course map. For example, an electronic device, such as a lap-top computer, might be used to furnish a more scenic set of course maps; however, each game stroke is still based on the stroke taken at the driving range. Likewise, a wider range of clubs could be necessitated or accommodated by re-fashioning the rules. It will also occur to those skilled in the art that this invention can be adapted and practiced on a smaller field, such as one's own property using proportional yardages. For example, an actual shot of 20 yards on the small practice field may represent 200 yards on the actual driving range. The ball locator means is still used to determine the direction of the actual shot versus the intended target and for placing the ball on the simulated course map.

Figure 4:
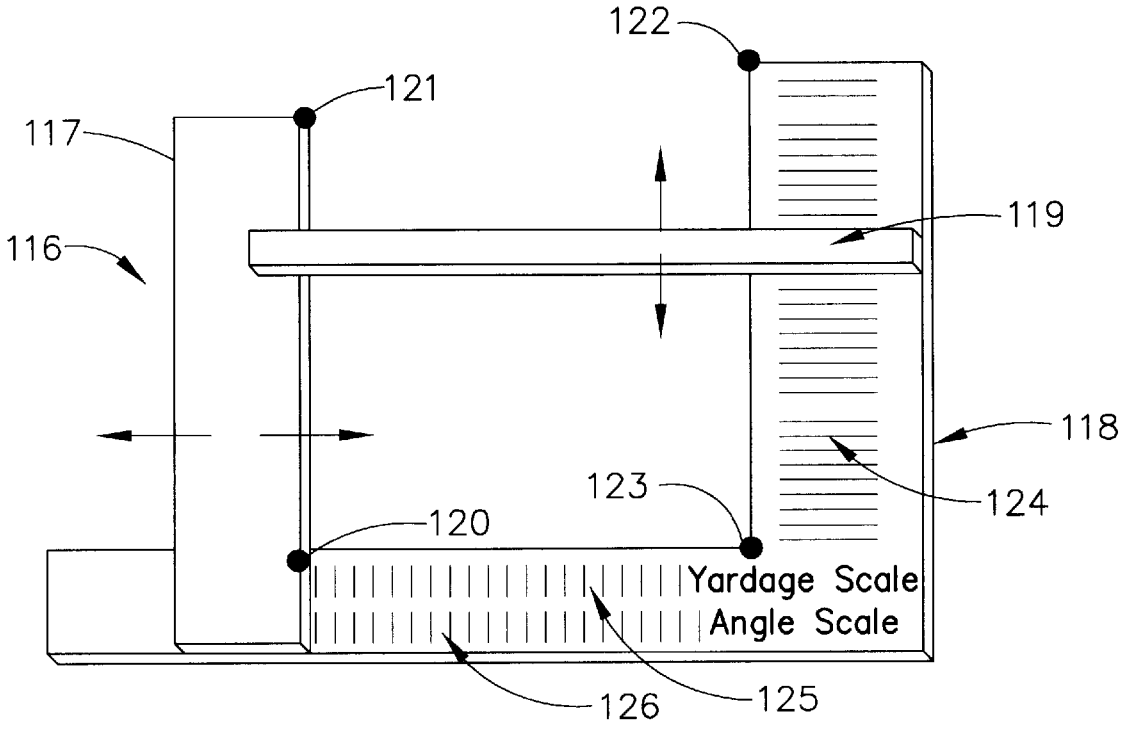
FIG. 4 shows an alternative ball locator means according to the present invention.

FIG. 4 shows another ball locator means 116 in accordance with the instant invention comprised of three elements. A rectangular leg 117 having indicia marks 120 and 121 slidably engages a generally L-shaped leg 118. Leg 118 has two yardage scales 124 and 125, one on each segment of said leg, each of which correspond to the scale of the golf course map. Said leg 118 includes indicia marks 122 and 123 positioned on its upright segment. Leg 118 also has an angle scale 126 which provides the actual angle of a shot as will be more fully appreciated in the discussion to follow. The third element is bar 119 which is connected to both leg 117 and the upright segment of leg 118 and is adapted to slide in either direction and to permit horizontal movement between leg 117 and itself.

Figure 4A:
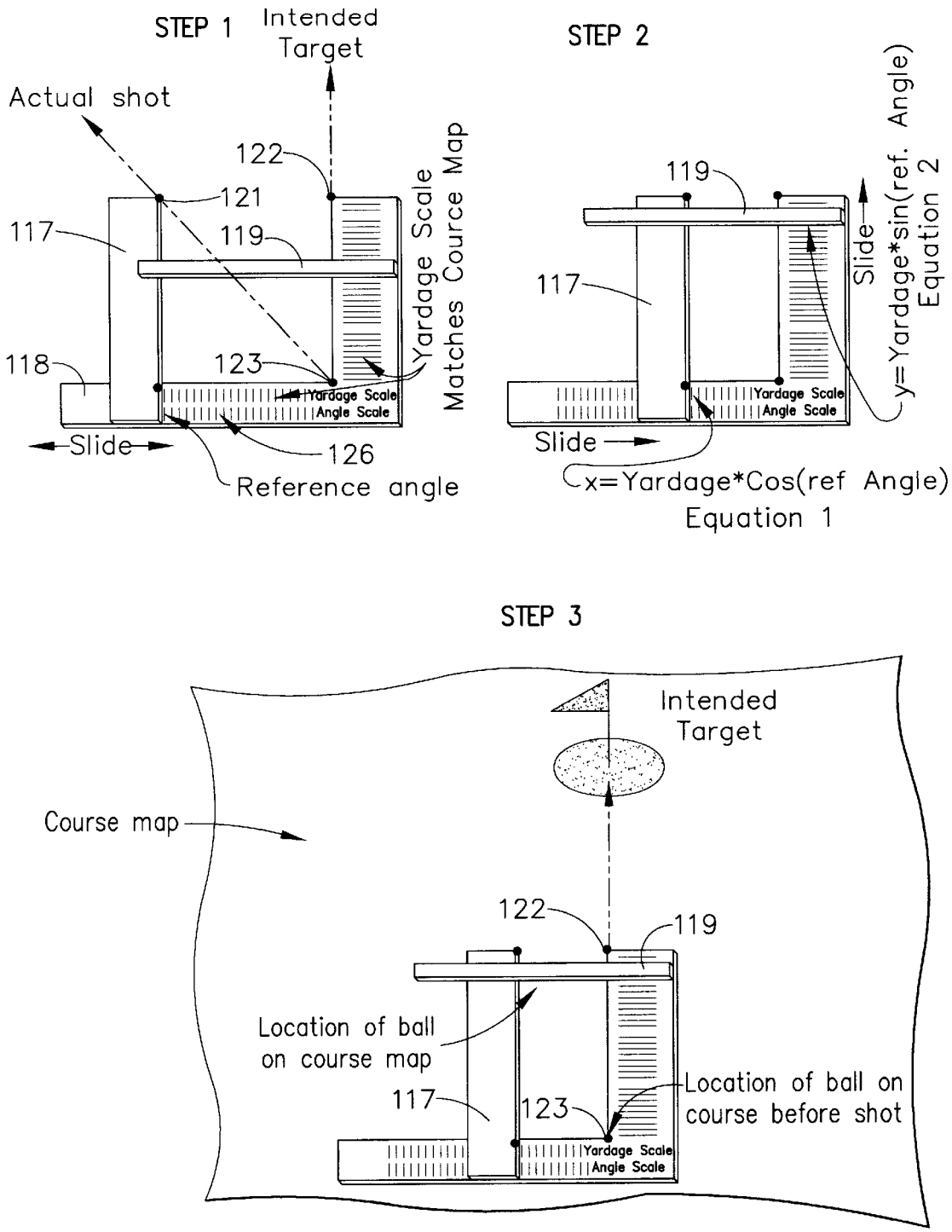
FIG. 4*a* shows the steps involved in using the alternative ball locator means of FIG. 4 when a player has hooked a shot.
Figure 4B:
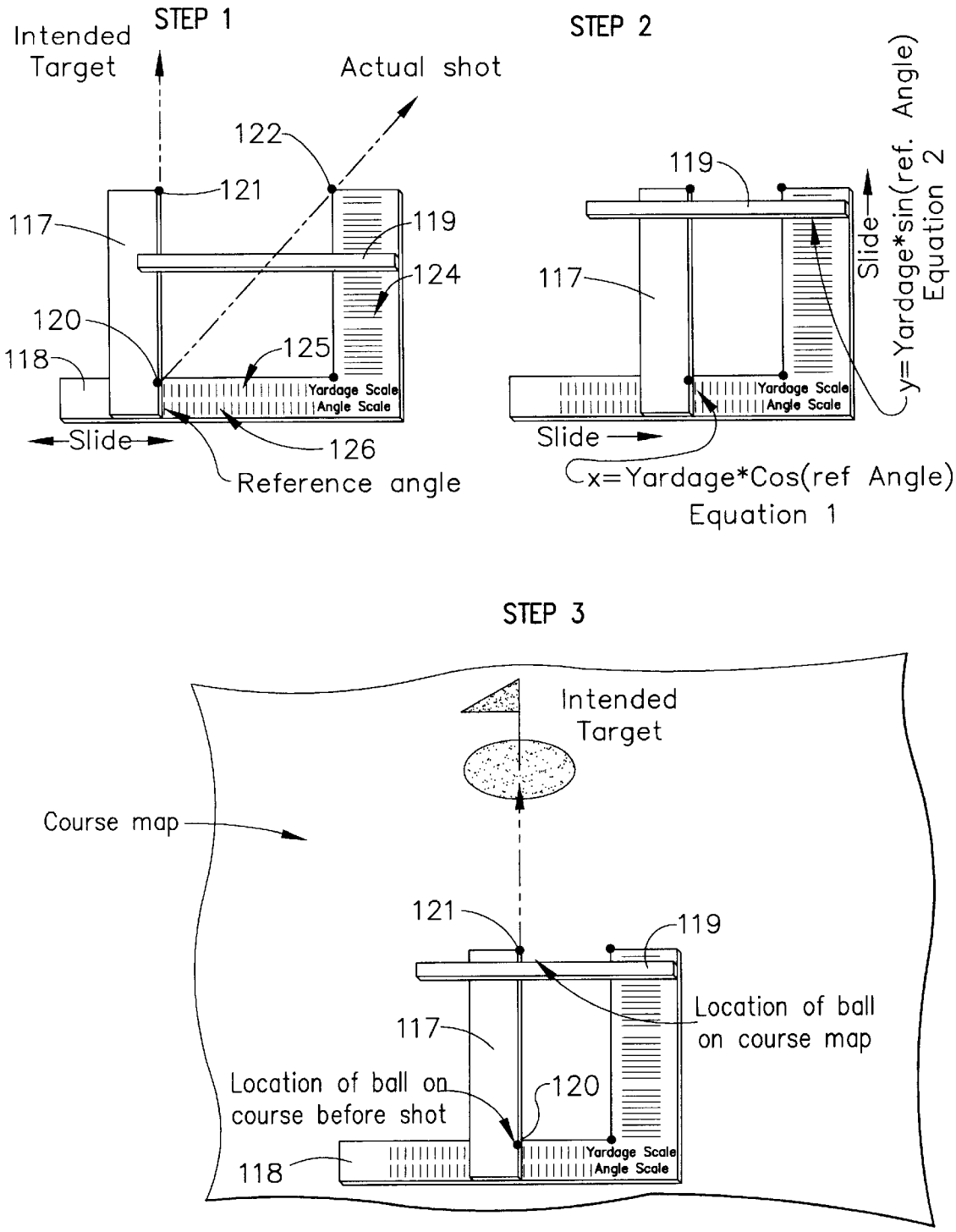
FIG. 4*b* shows the steps involved in using the alternative ball locator means of FIG. 4 when a player has sliced a shot.

FIGS. 4*a* and 4*b* illustrate the use of the ball locator means 116. If the shot taken at the golf driving range is to the left of the target, also known as a "hook", the steps illustrated in FIG. 4*a* are followed. With reference to Step 1, after taking the shot, the player aligns indicia 122 and 123 with the intended target. One then aligns indicia 121 and 123 with the actual direction of the shot by sliding leg 117 which will result in the inside edge of leg 117 coinciding with a particular angle on the angle scale 126. For purposes of this discussion the angle so indicated will be called the reference angle. One may then establish "x" and "y" Cartesian coordinates of the ball on the simulated course map by employing equations 1 and 2 as shown in Step 2 of FIG. 4*a*. Equation 1 provides the "x" coordinate: the product of the estimated distance of the shot times the trigonometric cosine function of the reference angle. Similarly, the "y" coordinate is calculated by determining the product of the estimated yardage of the shot and the trigonometric sine function of the reference angle. Leg 117 and bar 119 are then adjusted to the x and y yardage so calculated on yardage scales 124 and 125.

Step 3 illustrates the final step in plotting the new location of the golf ball. The ball locator means is overlaid on the course map, placing indicia 123 on the original location of the ball and aligning indicia 123 and 122 aligned with the intended direction of the shot or the intended target. The intersection of leg 117 with bar 119 provides the location of the ball on the simulated course map and is so marked.

FIG. 4*b* illustrates the steps to be taken when the shot has been hit to the right of the intended target, also known as a "slice". It is believed that the reader will understand the steps from the previous description. The only difference would be that indicia 120 and 121 are used to align with the intended target and indicia 120 and 122 are used to align with the path of the actual shot. The same equations are used and the ball locator means is adjusted as described above in order to plot the location of the ball on the simulated course map.

It will be appreciated that other configurations of the ball locator means may be devised by those skilled in the art. It will also be apparent that the ball locator means described herein can be used for simulating other games involving an object being sent toward a desired goal.

It is believed that the present invention provides many benefits to the user including better preparation for an actual round of golf by giving the user a format which encourages use of a wider variety of clubs, certainly more than is typical of a driving range visit. It also encourages improved accuracy, not only in distance but in direction via the use of the novel ball locator means device. The present invention is less expensive than an actual game of golf, and any golf course can be played if a course map is available. It is apparent that this game may be played despite actual weather conditions, and there is no pressure to play faster than one desires, since there are no groups that are waiting to play on the same course.

Many modifications may come to mind to those that are ordinarily skilled in the art and such can be made without departing from the scope of the invention. Accordingly, the scope is intended to be limited only by the following claims.

What is claimed is:

1. A simulated golf game apparatus for use with a conventional golf driving range or other practice field, comprising a golf course map in scale, and a portable ball locator means comprised of at least two members that are rotationally attached to each other, said ball locator means having the same scale as said golf course map, and having a means to measure the angle between an intended direction and the actual direction of a golf ball shot whereby the length and direction of each shot of the game is adapted to be plotted on said map according to the distance and accuracy of an actual shot toward an intended target on a golf driving range or other practice field, said ball locator means and said means to measure the angle being unitary.

2. A game in accordance with claim 1 wherein said at least two members are pivotally attached to each other.

3. A simulated golf game apparatus for use with a conventional golf driving range or other practice field, comprising a golf course map in scale, and a portable ball locator means comprised of at least two legs, one of said legs being generally L-shaped, and a bar that are slidably attached to each other, said ball locator means having the same scale as said golf course map, and having a means to measure the angle between an intended direction and the actual direction of a golf ball shot whereby the length and direction of each shot of the game is adapted to be plotted on said map according to the distance and accuracy of an actual shot toward an intended target on a golf driving range or other practice field, said ball locator means and said means to measure the angle being unitary.

* * * * *